US010113814B2

(12) United States Patent
Persson

(10) Patent No.: US 10,113,814 B2
(45) Date of Patent: Oct. 30, 2018

(54) DOUBLE DIMPLE PATTERN HEAT EXCHANGER

(71) Applicant: Danfoss A/S, Nordborg (DK)

(72) Inventor: Lars Persson, Guizhou (CN)

(73) Assignee: DANFOSS A/S, Nordborg (DK)

( * ) Notice: Subject to any disclaimer, the term of this patent is extended or adjusted under 35 U.S.C. 154(b) by 274 days.

(21) Appl. No.: 14/196,237

(22) Filed: Mar. 4, 2014

(65) Prior Publication Data

US 2014/0251587 A1 Sep. 11, 2014

(30) Foreign Application Priority Data

Mar. 8, 2013 (DK) ..... 2013 00126

(51) Int. Cl.
*F28F 3/04* (2006.01)
*F28F 3/08* (2006.01)

(52) U.S. Cl.
CPC ..... *F28F 3/044* (2013.01); *F28F 3/083* (2013.01)

(58) Field of Classification Search
CPC .. F28F 3/044; F28F 3/083; F28F 3/025; F28F 3/046; F28F 3/10; F28F 3/08; F28F 2265/14; F28F 2265/26; F28D 9/0037; F28D 9/0062; F28D 9/0068; F28D 9/0012; F28D 9/0087; F28D 9/0043; F28D 9/005
USPC ..... 165/164–167, 109.1, 170
See application file for complete search history.

(56) References Cited

U.S. PATENT DOCUMENTS 2,281,754 A 5/1942 Dalzell
2,441,476 A 5/1948 Ewald
2,481,046 A 9/1949 Scurlock
2,577,321 A 12/1951 Filger
2,627,283 A * 2/1953 Przyborowski ..... F01P 11/08 126/391.1
3,532,161 A 10/1970 Lockel
3,597,891 A 8/1971 Martin
3,664,928 A * 5/1972 Roberts ..... C02F 1/08 138/38
3,742,663 A 7/1973 Duskin
3,783,090 A 1/1974 Andersson et al.
(Continued)

FOREIGN PATENT DOCUMENTS

EP 1122505 A1 8/2001
EP 1933105 A1 6/2008
(Continued)

OTHER PUBLICATIONS

Masahiro, JP4072876—Machine-English-Translation.pdf, Apr. 9, 2008.*
(Continued)

*Primary Examiner* — Len Tran
*Assistant Examiner* — Jose O Class-Quinones
(74) *Attorney, Agent, or Firm* — McCormick, Paulding & Huber LLP

(57) ABSTRACT

The invention relates to a heat exchanger including a plurality of heat exchanger plates, wherein each of the heat exchanger plates has a plurality of dimples. The dimples have tops and bottoms. Furthermore, the tops of at least one heat exchanger plate are connected to the bottoms of a neighboring heat exchanger plate. In order to improve the efficiency and stability of the heat exchanger at least part of the dimples are connected to at least one adjacent dimple by a wall section.

16 Claims, 7 Drawing Sheets

(56) References Cited

U.S. PATENT DOCUMENTS

| | | | | | |
|---|---|---|---|---|---|
| 3,956,543 | A | | 5/1976 | Stangeland | |
| 4,471,759 | A | * | 9/1984 | Anderson | B29C 65/02 126/626 |
| 4,630,674 | A | | 12/1986 | Skoog | |
| 4,781,248 | A | | 11/1988 | Pfeiffer | |
| 4,919,200 | A | * | 4/1990 | Glomski | F28D 9/0037 165/166 |
| 5,398,751 | A | | 3/1995 | Blomgren | |
| 5,643,656 | A | | 7/1997 | Lin | |
| 5,968,321 | A | | 10/1999 | Sears | |
| 6,155,338 | A | * | 12/2000 | Endou | F28D 9/0025 165/165 |
| 6,221,463 | B1 | | 4/2001 | White | |
| 6,357,516 | B1 | | 3/2002 | Judge et al. | |
| 8,091,619 | B2 | | 1/2012 | Persson | |
| 2003/0029608 | A1 | * | 2/2003 | Shimoya | F28D 1/0316 165/152 |
| 2007/0006998 | A1 | | 1/2007 | Brost | |
| 2011/0036547 | A1 | | 2/2011 | Christensen et al. | |
| 2011/0088882 | A1 | | 4/2011 | Persson | |
| 2011/0120934 | A1 | | 5/2011 | Siverklev | |
| 2011/0180247 | A1 | | 7/2011 | Persson | |
| 2014/0251586 | A1 | | 9/2014 | Persson | |

FOREIGN PATENT DOCUMENTS

| | | | | | |
|---|---|---|---|---|---|
| GB | 901914 | A | | 7/1962 | |
| GB | 1468514 | | | 3/1977 | |
| JP | 4072876 | B2 | * | 4/2008 | F28D 9/0062 |
| RU | 2164332 | C2 | | 3/2001 | |
| SU | 1257402 | A2 | | 9/1986 | |
| WO | 8808508 | A1 | | 11/1988 | |
| WO | 9300563 | A1 | | 1/1993 | |
| WO | 9712189 | A1 | | 4/1997 | |
| WO | 02053998 | A1 | | 7/2002 | |
| WO | 2009112031 | A2 | | 9/2009 | |

OTHER PUBLICATIONS

European Search Report Serial No. EP14153900 dated Jul. 17, 2015.

European Search Report Serial No. EP14153906 dated Jul. 20, 2015.

Danish Search Report for Serial No. PA 2013 00120 dated Oct. 16, 2013.

Danish Search Report for Serial No. PA 2013 00126 dated Oct. 16, 2013.

* cited by examiner

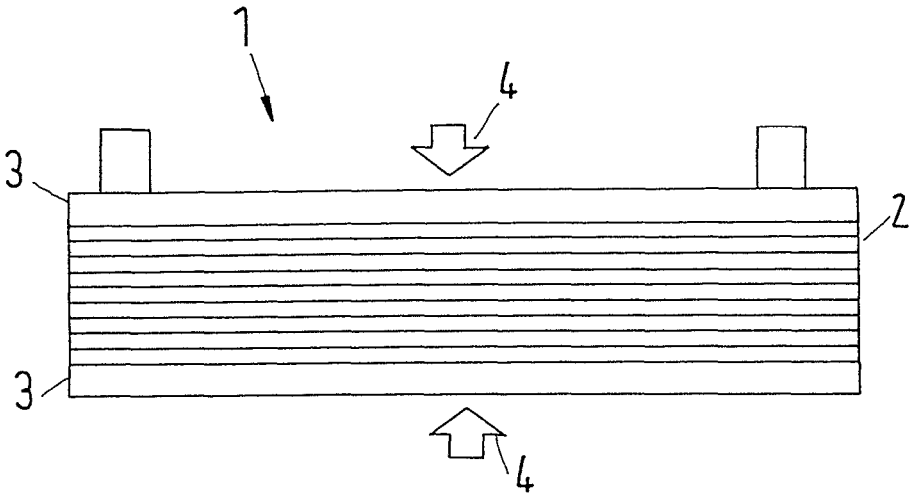
Fig.1
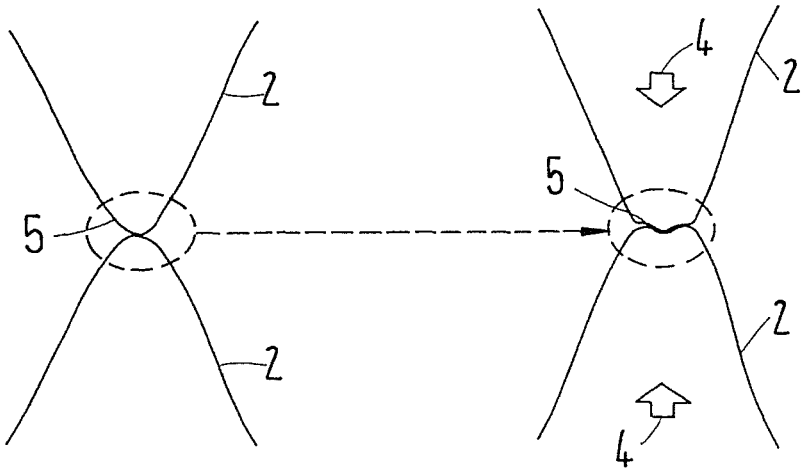
Fig.2A
Prior Art
Fig.2B
Prior Art

DOUBLE DIMPLE PATTERN HEAT EXCHANGER

CROSS REFERENCE TO RELATED APPLICATION

Applicant hereby claims foreign priority benefits under U.S.C. § 119 from Danish Patent Application No. PA 2013 00126 filed on Mar. 8, 2013, the contents of which are incorporated by reference herein.

TECHNICAL FIELD

The invention relates to a heat exchanger comprising a plurality of heat exchanger plates, wherein each of the heat exchanger plates comprises a plurality of dimples, and wherein the dimples comprise tops and bottoms, and wherein the tops of at least one heat exchanger plate are connected to bottoms of another neighboring heat exchanger plate.

BACKGROUND

Plate heat exchangers are well known devices for the transport for heat between two different media, in particular fluids. Such plate heat exchangers usually comprise a plurality of heat exchanger plates, wherein each heat exchanger plate comprises a pattern of indentations as well as inlets and outlets for the two media. Each pair of neighboring plates is joined in such a way that channels for the transport of the separate media are created. The two media will then be allowed to circulate between alternating pairs of plates to allow a transfer of heat through the heat exchanger plates. The pattern of indentations of one plate will be in contact with the indentation patterns of the two neighboring plates. This way the plates are kept slightly spaced and the shape of the fluid path can be adjusted to improve the efficiency of the heat exchange.

In the state of the art, it is common to use a so called herringbone pattern of indentations comprising ridges and valleys that force the flow of the media to accelerate and decelerate repeatedly within the plane of the heat exchanger plate. This usually leads to a large variation of the speed, or flow rates, of the fluids which reduces the effectiveness of the heat transfer. Thus, a pattern of indentations that allows for a more homogeneous speed of the fluids would be beneficial.

In order to improve the efficiency of the heat exchange, it has been tried to reduce the surface area used as contact surface of the neighboring heat exchanger plates or to reduce the thickness of the heat exchanger plates. Both measures may be problematic because they reduce the durability of the heat exchanger plates. In particular the high fluid pressures as well as for some cases the external pre-tension will expose the contact surfaces of the heat exchanger plates with large forces. Thus, if the contact areas of the heat exchanger plates and/or the thickness of the heat exchanger plates are too small, these forces can lead to permanent deformations of the heat exchanger plates.

In U.S. Pat. No. 8,091,619 B2 a heat exchanger of the type mentioned above is disclosed. Therein the herringbone pattern of indentations is replaced by a plurality of dimples, comprising tops and bottoms. The flat tops of one plate are brazed together with the flat bottoms of a neighboring plate. Thus, the stability of such a brazed heat exchanger can be improved allowing to reduce the thickness of the heat exchanger plates. At the same time the surface area at which the two neighboring plates meet is optimized. Thus the efficiency of such a plate heat exchanger is improved.

Such a construction has the disadvantage that the fluid flow is harder to direct and distribute across the whole plane of the heat exchanger plate. This is one reason why such heat exchangers and those having e.g. herringbone patterns, has relative slim and long designs, this reducing the width to which the fluids is to flow.

For herring bone exchangers with wedge shaped flow channels, the higher the angle of the wedge shape the lower pressure drop seen in the width direction (orthogonal to the overall flow direction seen from inlet to outlet) and higher drop in the overall flow direction, whereas by making a more narrow wedge shape with a smaller angle the pressure drop in the width direction increases whereas the pressure drop in the overall flow direction decreases. This including the height and slope of the sides of the corrugations in herringbone patterns are the parameters that may be changed to obtain a given desired flow/pressure characteristic of the heat exchanger. Increasing the width of the channels by increasing the top surface area of the patterns would reduce the total heat exchange surface and this is not a desired option. Changing one parameter to obtain a desired pressure/flow/speed characteristic thus compromises another.

Further disadvantages especially for embodiments with gasket heat exchangers, where the plates are connected and fixed together such as by bolts, and where gaskets at the circumference seals the flow channels, is related to the height of the plates, being the height from top to bottom. It may be an advantage for such heat exchangers, given a certain length and width, to be able to use the same gaskets despite the height of the actual design, as this would lower production costs. With the pattern design from U.S. Pat. No. 8,091,619 B2 it may not be possible to design plates with larger height still maintaining the desired pressure drops of the fluids within.

SUMMARY

Consequently, the task of the invention is to provide a heat exchanger with a more advantageous pattern of indentations that allows for a higher stability and a reduced thickness of the heat exchanger plates. At the same time it should be possible to direct the fluid flow more effectively than with the dimple pattern according to the U.S. Pat. No. 8,091,619 B2, thus making it possible to form more squared heat exchangers, or to be able to define a given height to a certain gasket, still being able to design to desired pressures/pressure drops, flow and speed characteristic in all directions The present invention solves the above problem in that at least parts of the dimples are connected to at least one adjacent dimple by a wall section.

The wall sections will at the one hand provide additional obstacles to the fluid flow, allowing to more effectively direct the fluid flow across the plane of the heat exchanger plates. The invention may be used for brazed heat exchangers as well as for gasketed heat exchangers or any other type of heat exchanger using heat exchanger plates. In the most simple embodiment the dimples comprising tops will form pairs and the dimples comprising bottoms will form pairs, each of which are connected by one wall section. Of course there can also be more complicated patterns of multiple dimples connected by one or several wall sections, as will be explained in the following.

It is preferred if at least some of the wall sections have the same height as the dimples. Consequently the tops and/or the bottoms as well as the connecting wall section can form a single contact surface. Here and in the following the term height is used for both the height of the dimples comprising tops as well as for the depth of the dimples comprising bottoms, i.e. how far the dimple or wall section protrudes in a direction perpendicular to the plane of the heat exchanger plate. Such wall sections that have the same height as the dimples will thus completely block the fluid flow between the dimples they connect.

It is furthermore preferred if at least some of the wall sections have a lower height as the dimples. Again height here refers to both the height of the dimples comprising tops as well as to the depth of the dimples comprising bottoms. Such wall sections with a lower height will allow to reduce the fluid flow in some directions while not completely blocking it.

It is also preferred if at least some of the dimples and/or the wall sections comprise concave surface sections and/or convex surface sections. Such concave and/or convex surface sections will allow to more effectively direct the fluid flow along or around the wall sections. This may also prevent the occurrence of a laminar fluid flow if several subsequent wall sections should be arranged between several dimples along the same direction. The shape of the wall sections can also be adjusted to the shape of the dimples they connect. For example if the dimples have a substantially circular circumference comprising convex surface sections, then the wall sections could comprise mostly concave surface sections. Consequently the fluid would be forced to smoothly change the direction several times while flowing around the dimples connected by the wall sections.

It is furthermore preferred if at least some of the wall sections connect three or more dimples. This could for example be the case if several wall sections connect dimples comprising tops or if several wall sections connect dimples comprising bottoms. Thus one may form relatively large barriers to the fluid flow for example by creating rows of dimples connected by wall sections. Alternatively one may also connect small clusters of dimples using the wall sections, forming for example rectangular groups of four or more dimples connected by four or more wall sections. Another example may be a plus-shaped group of five or more dimples connected by four or more wall sections. Such larger groups of dimples connected by wall sections may be beneficial to improve the stability of the heat exchanger plates locally or to produce larger obstacles for the fluid flow.

In another preferred embodiment the dimples and/or the wall sections are elastically deformable (or in alternative wording elastically compressible), in the context meaning that they may change shape slightly due to a bending of the wall material, but that this it is reversible. Thus if the forces acting on the dimples, in particular the tops and bottoms become too large the dimples and/or the wall sections can deform elastically. Consequently plastic deformations that may lead to permanent damage to the heat exchanger will be avoided. Such strong forces for example occur in case of gasketed heat exchangers where relative pressures of the fluids changes.

In another preferred embodiment at least some of the wall sections have a width that is smaller than a maximum width of the dimples. Thus the wall sections will be relatively thin and not increase the contact surface of the two neighboring heat exchanger plates by a lot. For example two neighboring dimples that are connected to one another by a wall section could have a substantially 8-shaped circumference, forming a dimple pair. This would also significantly increase the total heat exchanging area.

It is furthermore preferred if at least part of the dimples comprising tops are arranged in first rows and at least part of the dimples comprising bottoms are arranged in second rows. This way one may arrange the dimples in patterns that are particularly beneficial for the fluid flow between each two heat exchanger plates. In particular it is possible to make the fluid flow reach all parts of the heat exchanger plates resulting in a higher efficiency of the heat exchanger. For example along the first rows comprising tops the fluid flow will be reduced or completely blocked depending on the height of the wall sections. On the other hand along the second rows comprising bottoms the fluid flow may be enhanced.

It is furthermore preferable if all dimples in each first row as well as in each second row are connected by wall sections. Consequently relatively large obstacles for the fluid flow as well as relatively long fluid pathways can be created within the plane of the heat exchanger plate. If the wall sections in this case comprise convex and/or concave surface sections the fluid flow along the wall sections will be improved, because the occurrence of a laminar fluid flow along such extended fluid barriers can be avoided.

In another preferred embodiment in each first row and in each second row wall sections with the same height as the dimples are arranged alternately with wall sections with a lower height as the dimples. Thus the first and second rows will not form impenetrable barriers to the fluid flow, but rather shape the main directions of the fluid flow while still allowing some of the fluid to pass at wall sections with a lower height.

It is also preferred if at least part of the first and second rows are arranged parallel to an edge of the heat exchanger plate. Thus, one may for example ensure that the fluids will also flow towards the edges of the heat exchanger plates resulting in a more homogenous fluid flow across the whole area of the heat exchanger plates.

It is also preferred if at least part of the first and second rows are arranged at an angle to an edge of the heat exchanger plate. In particular, some of the first and second rows may be arranged at an angle of 20° to less than 45° to an edge of the heat exchanger plate. This way it is ensured that the fluid flow can be efficiently directed towards all parts of the heat exchanger plate without too abrupt changes in the direction of the fluid flow. Furthermore since the fluid usually has to enter through one inlet and exit through one outlet the fluid flow has to be spread out from the inlet across the whole plane of the heat exchanger plate and then needs to be redirected towards the outlet of the heat exchanger plate.

It is furthermore preferable if at least part of the first and second rows change direction within the plane of the heat exchanger plate. Consequently the first and second rows may for example form wedges or zig-zag patterns within the plane of the heat exchanger plate to optimize the fluid flow.

In another preferred embodiment at least part of the dimples comprising tops are arranged alternately with dimples comprising bottoms along a direction parallel to an edge of the heat exchanger plate. Consequently the fluids will be forced to change their direction repeatedly to flow around the dimples for example in a slalom-like path.

In another preferred embodiment at least part of the dimples comprising tops are arranged alternately with dimples comprising bottoms along a direction inclined to an edge of the heat exchanger plate. This way one may create relatively direct fluid pathways in a direction inclined to an edge of the heat exchanger plate. Such a pattern may for example be beneficial close to the inlet as well as close to the outlet of the heat exchanger plate. Consequently the fluid flow can be either spread out from an inlet or be brought together to flow into the outlet.

BRIEF DESCRIPTION OF THE DRAWINGS

The invention will now be described in detail below with reference to the attached drawings, of which:

FIG. 1 is a cut view of a heat exchanger,

FIG. 2*a*, 2*b*, 3 show a plastic deformation of a contact area of two heat exchanger plates according to the state of the art.

DETAILED DESCRIPTION

In FIG. 1 a cut view of a heat exchanger 1 comprising a plurality of heat exchanger plates 2 is shown. The heat exchanger plates 2 are stacked on top of each other creating a plurality of fluid paths between them. The heat exchanger plates 2 are arranged between top and bottom plates 3. Consequently, the heat exchanger plates 2 may be held under a pretension by an external pressure. Forces 4 can for example be introduced by connecting the top and bottom plates 3 by a way of introducing bolts through bores in the top and bottom plate 3 as well as the heat exchanger plates 2.

Figure 3:
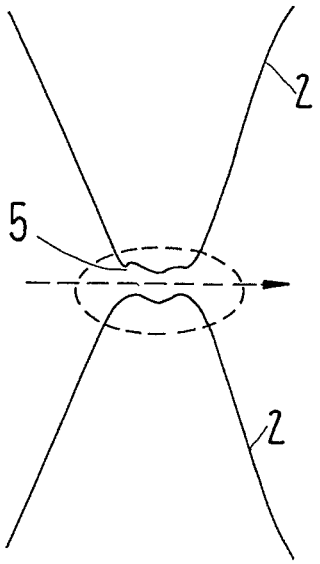
Fig.3 Prior Art

In FIGS. 2*a*, 2*b* and 3, a problem of heat exchangers according to the state of the art is disclosed. FIG. 2*a* therein shows a contact area 5 of two heat exchanger plates 2. According to the state of the art, the contact area 5 is in this case formed by a valley of the top heat exchanger plate 2 meeting a ridge of a bottom heat exchanger plate 2. In order to improve the heat exchange, the contact area 5 of the two neighboring heat exchanger plates 2 is chosen to be very small.

According to FIG. 2*b* forces 4 as mentioned earlier will now press the two neighboring heat exchanger plates 2 together, which may result in a plastic deformation of the very small contact area 5. In FIG. 3 the contact area 5 is shown again after the forces 4 have either vanished or have been severely reduced, for example due to a change of the internal fluid pressure. In this case, the two neighboring heat exchanger plates 2 are permanently deformed and do no longer stay in contact in the contact area 5. Thus a bypass for the fluid flow is formed. This in turn will usually reduce the efficiency of the heat exchanger, because more direct fluid paths from the inlet to the outlet may open up which will result in the fluid flow no longer being optimally distributed between the two heat exchanger plates.

Figure 4:
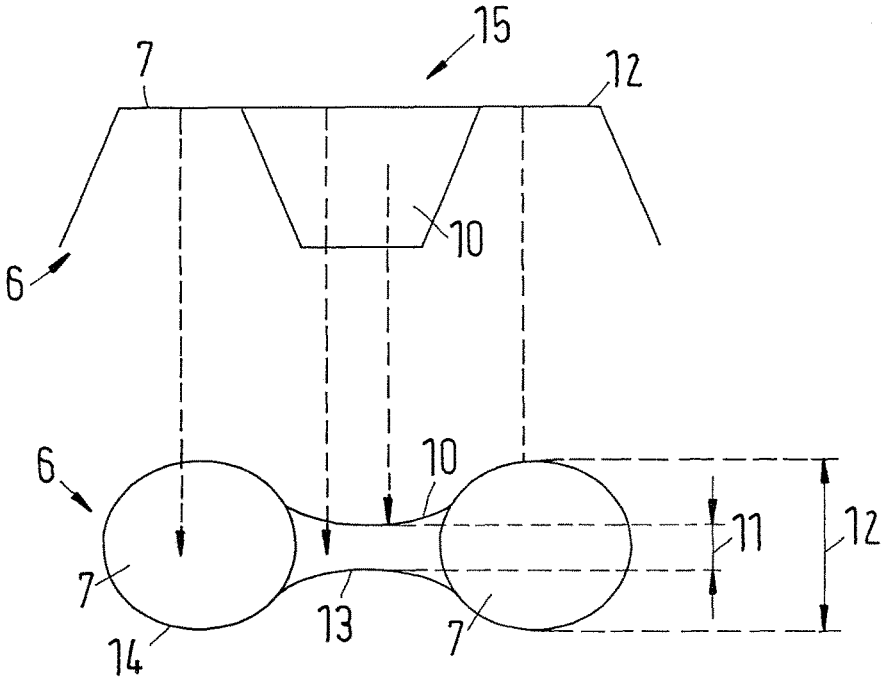
FIG. 4 shows a first embodiment for a pair of dimples connected by a wall section.

FIG. 4 now shows a cut view of a heat exchanger plate 2 according to the invention, in particular a pair of dimples 6 comprising tops 7. The following description of the embodiment of a pair of dimples 6 comprising tops 7 may be realized correspondingly for dimples 6 comprising bottoms 9. According to FIG. 4 a pair of adjacent dimples 6 comprising tops 7 is connected to each other by a wall section 10. In this case the wall section 10 has the same height as the dimples 6 that it connects. Consequently the pair of dimples 6 together with the wall section 10 may form a closed barrier to the fluid flow.

In the lower part of FIG. 4 a top view of the pair of dimples 6 is shown. In this embodiment the wall section 10 has a minimum width 11 that is smaller than the maximum width 12 of the dimples 6 it connects, thus increasing the heat transfer area. Consequently the wall section 10 will only slightly increase the contact area of the heat exchanger plates 2. Furthermore the wall section 10 in this case comprises concave surface sections 13. At the same time the dimples 6 comprise convex surface sections 14. Of course, the circumference of such a pair of dimples comprising a wall section may be of any shape, for example the wall section 10 may also comprise convex surface sections 14 or the dimples 6 may comprise concave surface sections 13.

A pair of dimples 6 as disclosed in FIG. 4 thus forms a closed dimple pair 15 that may completely block the fluid flow between them.

Figure 5:
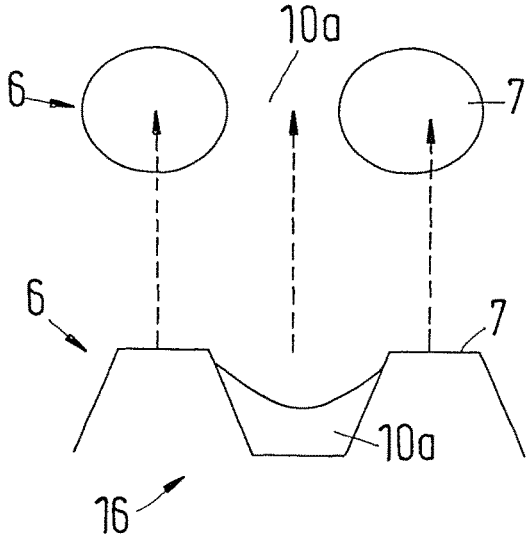
FIG. 5 shows another embodiment of a pair of dimples connected by a wall section.

In FIG. 5 a different embodiment of a pair of dimples 6 is disclosed. In this case the wall section 10*a* between the two dimples 6 comprising tops 7 has a lower height as the dimples 6 and in particular the tops 7. The pair of dimples 6 does in this case form an open dimple pair 16. In the upper section of FIG. 5 a top view of the open dimple pair 16 is shown. For a better distinction of closed dimple pairs 15 and open dimple pairs 16 the wall section 10*a* is in this top view not shown. This does not mean that the wall section 10*a* is not present, but rather that an open fluid path is present between the two dimples 6.

Figure 6A:
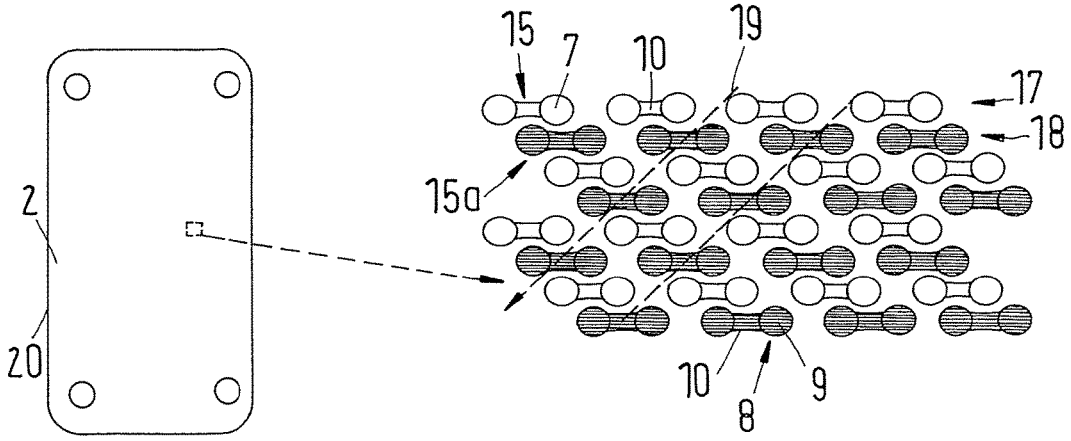
FIG. 6*a* shows a first embodiment of a pattern of dimples arranged on a heat exchanger plate according to the invention.
Figure 6B:
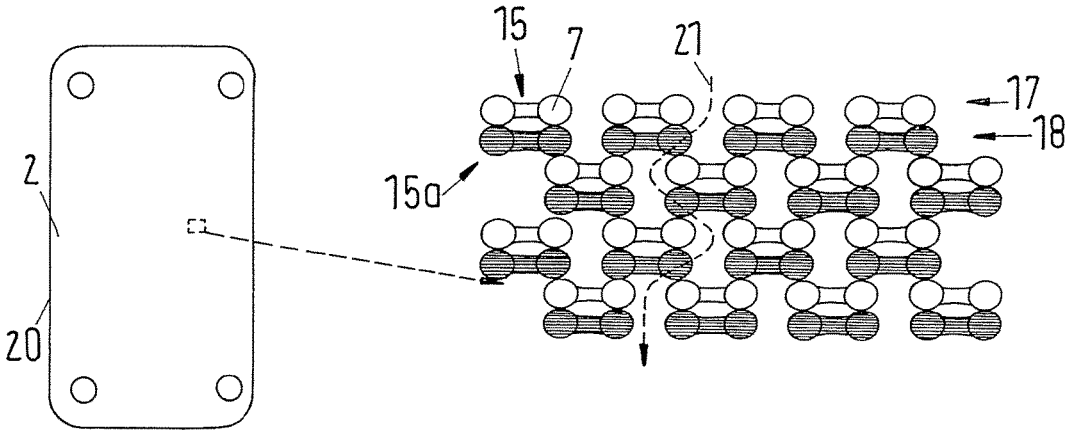
FIG. 6*b* shows a second embodiment of a pattern dimples arranged on a heat exchanger plate according to the invention.

FIGS. 6*a* and 6*b* show on the left side a simplified top view of a heat exchanger plate 2. On the right side of FIGS. 6*a* and 6*b* enlarged views of small sections of the heat exchanger plate 2 is disclosed.

According to FIG. 6*a* closed dimple pairs 15 comprising tops 7 are arranged in first rows 17. At the same time closed dimple pairs 15*a* comprising bottoms 9 are arranged in second rows 18. In this case substantially direct fluid paths 19 will open up in diagonal directions along the dashed lines. Here the first rows 17 comprising tops 7 form barriers to the fluid flow. In particular the closed dimple pairs 15 completely block the fluid flow, while the tops 7 of adjacent closed dimple pairs 15 may either not be connected by a wall section 10, 10*a* or they may form an open dimple pair 16. Either way at least some fluid flow between each pair of adjacent closed dimple pairs 15 is possible in each of the shown first rows 17.

In contrast to that along the second rows 18 closed dimple pairs 15*a* comprising bottoms 9 are arranged. Along these second rows 18 the fluid can flow more or less freely. Furthermore by choosing the relative arrangement of the closed dimple pairs 15 comprising tops 7 relative to the closed dimple pairs 15*a* comprising bottoms 9 one may in this case choose whether the fluid will preferably flow to the left or to the right when coming from above.

According to this embodiment the dimples 6 comprising tops 7 are arranged alternately with dimples 8 comprising bottoms 9 along a direction inclined to an edge 20 of the heat exchanger plate 2.

In FIG. 6*b* an alternative embodiment of a heat exchanger plate 2 according to the invention is disclosed. Therein the relative arrangement of the dimples 6 comprising tops 7 to the dimples 8 comprising bottoms 9 is changed as compared to FIG. 6*a*. In this case the dimples 6 comprising tops 7 are arranged alternately with dimples 8 comprising bottoms 9 along a direction parallel to an edge 20 of the heat exchanger plate 2. Also when going from top to bottom in FIG. 6*a* each first row 17 is followed by a second row 18, wherein the closed dimples 15, 15*a* are arranged synchronously in both rows. For the following two rows 17, 18 the closed dimple pairs 15, 15*a* will be displaced compared to the previous two rows 17, 18. Consequently the fluid path 21 will in this case be slalom-like in shape. In other words the fluid path 21 may change the direction in each first row 17. This way it is ensured that the fluid has to change direction repeatedly ensuring that the fluid reaches all parts of the heat exchanger plate 2 evenly. At the same time the distance the fluids have to cover will be increased without forcing too abrupt direction changes onto the fluids.

In both FIGS. 6*a* and 6*b* going along a first row 17 one will find closed dimple pairs 15 with dimples 7 connected by wall sections 10, having the same height as the dimple 7 that they connect. After each such closed dimple pair 15 either a wall section 10*a* with a lower height as the dimples 7 will be arranged or there may be even no wall section 10, 10*a* at all. Next one will again find a closed dimple pair 15 comprising a wall section 10 with the same height as the tops 7. Thus completely blocked sections will alternate with openings for the fluid periodically. In the second rows 18 the closed dimple pairs 15*a* are arranged correspondingly. Of course numerous different ways of arranging the dimples 7, 9 in the plane of the heat exchanger plate 2 are possible. In particular it is not necessary that the dimples 7, 9 are arranged in such a highly symmetric fashion over the whole plane of the heat exchanger plate 2.

Figures 7A, 7B, 7C:
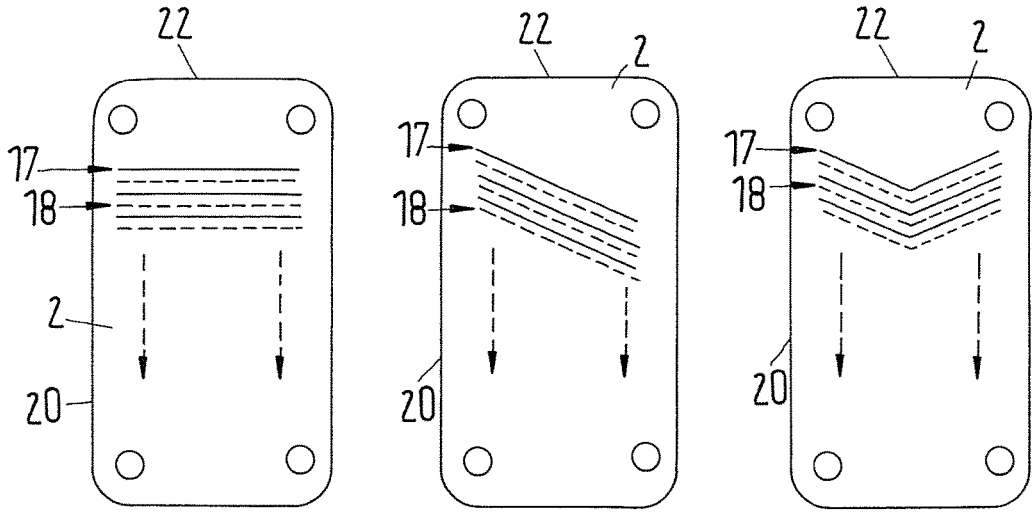
FIG. 7*a*, 7*b*, 7*c* show three different kinds of patterns of first and second rows of dimples on a heat exchanger plate according to the invention.

In FIGS. 7*a*, 7*b* and 7*c* three different ways of arranging the first rows 17 and second rows 18 within the plane of the heat exchanger plate 2 are disclosed. First rows 17 are shown as solid lines, while second rows 18 are shown as dashed lines. One may use one or several of these different kinds of arrangements for different areas of a heat exchanger plate 2. In FIGS. 7*a*, 7*b* and 7*c* it is not in detail shown where sections 10 with the same height as the dimples 7, 9 are arranged and where wall sections 10*a* with a lower height as the dimples 7, 9 appear. Here it is mostly shown how one may arrange the first rows 17 and second rows 18 within the plane of the heat exchanger plate 2.

In FIG. 7*a* the first rows 17 and second rows 18 are arranged parallel to an edge 22 of the heat exchanger plate 2. Consequently the arrangement is similar to the ones shown in FIGS. 6*a* and 6*b*. In FIG. 7*b* the first rows 17 and second rows 18 are arranged inclined to an edge 22 of the heat exchanger plate 2. One may also use different angles of inclination for the first rows 17 and second rows 18 within the same heat exchanger plate 2. Such an example is shown in FIG. 7*c* where the first rows 17 and second rows 18 change direction within the plane of the heat exchanger plate 2. Therein the first rows 17 and second rows 18 form wedges 23 in the heat exchanger plate 2. The first rows 17 and second rows 18 may also change direction several times within the plane of the heat exchanger plate 2.

Of course one may use a combination of different patterns for the first rows 17 and the second rows 18 to achieve an optimal distribution of the fluid flow over the whole plane of the heat exchanger plate 2 to improve the efficiency of the heat exchanger 1.

Figure 8:
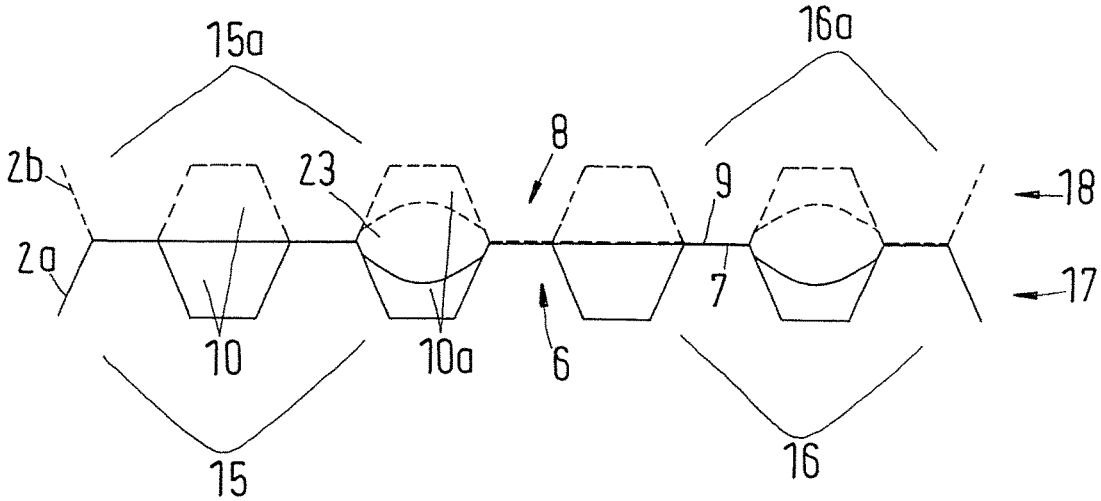
FIG. 8 shows a cross section through two neighboring heat exchanger plates according to the invention.

In FIG. 8 a cross section of two neighboring heat exchanger plates 2*a* and 2*b* is shown. Therein the heat exchanger plate 2*a* is arranged below the heat exchanger plate 2*b*. FIG. 8 here shows how a first row 17 comprising tops 7 of the lower heat exchanger plate 2*a* is in contact with a second row 18 comprising bottoms 9 of the upper heat exchanger plate 2*b*. Dimples 6 comprising tops 7 are in contact with dimples 8 comprising bottoms 9. In this case closed dimple pairs 15 comprising tops 7 are alternating with open dimple pairs 16 also comprising tops 7 in the lower heat exchanger plate 2*a*. At the same time in the upper heat exchanger plate 2*b* closed dimple pairs 15*a* comprising bottoms 9 alternate with open dimple pairs 16*a* also comprising bottoms 9. Thus wall sections 10 with the same height as the tops 7 or the bottoms 9 are in contact with each other completely blocking the fluid path where the closed dimple pairs 15 and 15*a* meet. At the same time at the sections where the open dimple pairs 16 and 16*a* with reduced wall sections 10*a* meet an opening 23 for the fluid flow remains. Instead of reduced wall sections 10*a* one may also use no wall sections at all to increase the fluid flow through the openings 23. Consequently it becomes clear how the first rows 17 of a lower heat exchanger plate 2*a* in contact with a second row 18 of an upper heat exchanger plate 2*b* can be used to shape the fluid pathways across the heat exchanger plate 2 as desired to improve the efficiency of the heat exchanger 1.

Figure 9A:
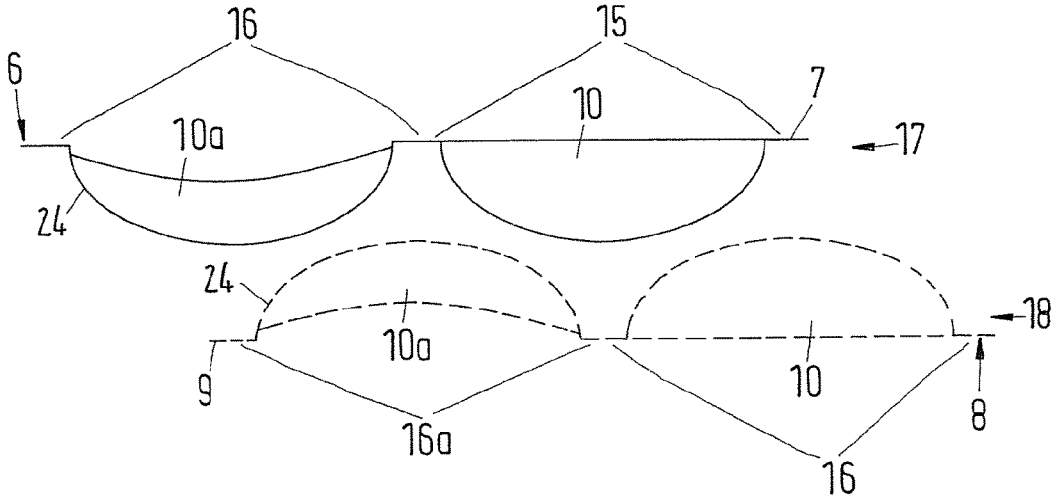
FIG. 9*a*, 9*b* show two embodiments of a heat exchanger plate according to the invention in cut views.

FIG. 9*a* shows a horizontal cut view through a heat exchanger plate 2 according to the embodiment shown in FIG. 6*a*. The solid line here shows a first row 17 comprising tops 7 while the dashed lines show a second row 18 comprising bottoms 9 arranged adjacent to the first row 17. In the first row 17 open dimple pairs 16 comprising tops 7 alternate with closed dimple pairs 15 comprising tops 7. In the second row 18 open dimple pairs 16*a* comprising bottoms 9 alternate with closed dimple pairs 16 comprising bottoms 9.

Figure 9B:
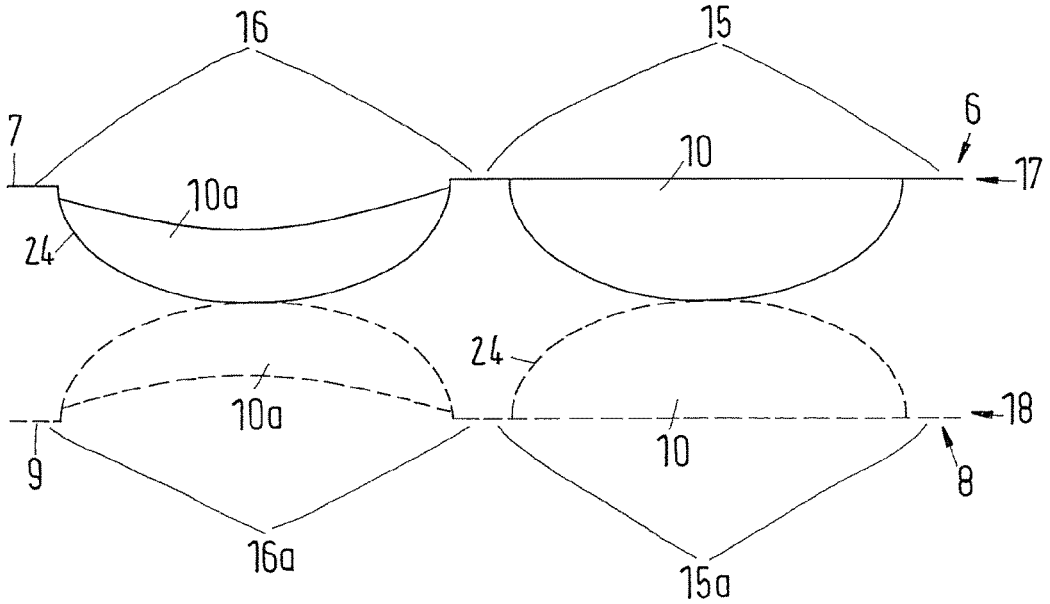

In FIG. 9*b* a horizontal cut view through a heat exchanger plate 2 according to the embodiment shown in FIG. 6*b* is shown. Herein again the solid lines show a first row 17 while the dashed lines show a second row 18 arranged adjacent to the first row 17. When comparing with FIG. 6*b* it becomes clear that dimples 6 comprising tops 7 are arranged alternately with dimples 8 comprising bottoms along a direction parallel to the edge 20 of the heat exchanger plate 2. Similar to the embodiment shown in FIG. 9*a* wall sections 10*a* with a lower height as the dimples are arranged alternately with wall sections 10 with the same height as the dimples both in the first row 17 as well as in the second row 18.

Furthermore, FIGS. 9*a* and 9*b* also show an alternative shape of the dimples 6, 8. Therein the dimples 6, 8 comprise flanks 24 that are substantially ellipse-shaped between adjacent tops and between adjacent bottoms. This way one may for example ensure that the dimples 6, 8 are elastically deformable. The flanks 24 may also be substantially straight as shown in FIG. 8. If the dimples 6, 8 are elastically deformable the heat exchanger plates 2 will be more resistant to the large forces acting upon them caused by the internal fluid pressures as well as for gasketed heat exchangers the pre-tension forces.

Figure 10:
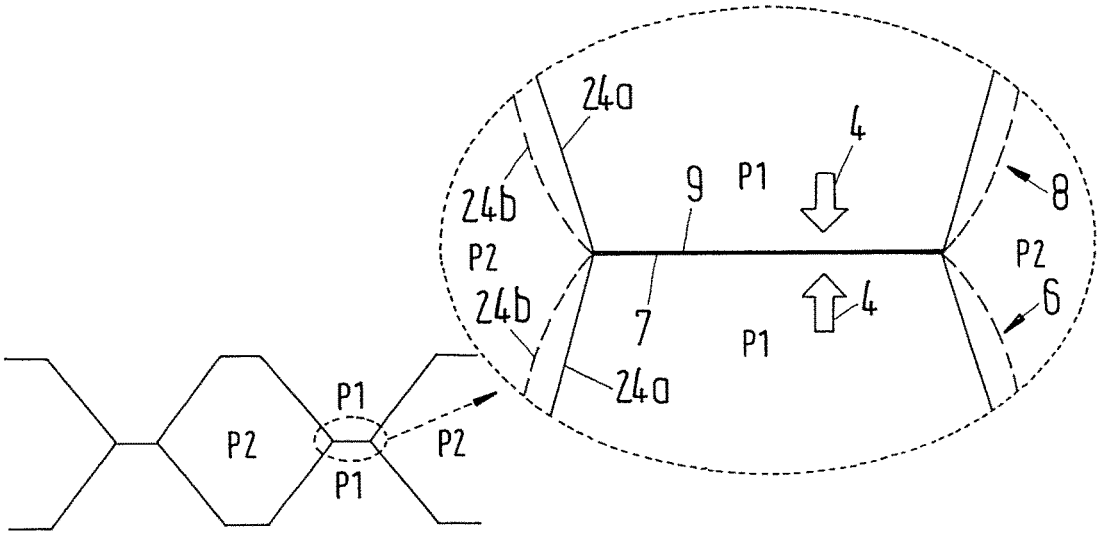
FIG. 10 shows an elastic deformation of two dimples in contact to each other.

In FIG. 10 an elastic deformation of a pair of dimples 6, 8 in contact with each other at a top 7 and a bottom 9 is shown, this being due to the pressure P1 of the fluid at the one side of the flank 24 being larger than the pressure P2 of the fluid at the other side of the flank 24.

The flanks 24 will deform elastically from non-deformed flanks 24*a* into deformed flanks 24*b*. In FIG. 10 deformed shapes are shown by dashed lines, while non-deformed shapes are shown as solid lines.

The elastic deformations of the dimples 6, 8 will result in spring forces acting against the external forces 4. Once the external forces 4 are reduced, the elastically deformed flanks 24*b* will revert to their non-deformed shapes 24*a*. Consequently, permanent deformations of the contact areas of the heat exchanger plates 2 as shown in FIGS. 2*a*, 2*b* and 3 will be prevented by making the dimples 6, 8 elastically deformable.

While the present invention has been illustrated and described with respect to a particular embodiment thereof, it should be appreciated by those of ordinary skill in the art that various modifications to this invention may be made without departing from the spirit and scope of the present.

What is claimed is:

1. A heat exchanger comprising a plurality of heat exchanger plates, wherein each of the heat exchanger plates comprises a plurality of dimples, wherein the plurality of dimples comprise tops and bottoms, wherein the dimple tops of at least one heat exchanger plate are aligned with and connected to the dimple bottoms of a first neighboring heat exchanger plate and the dimple bottoms of the at least one heat exchanger plate are aligned with and connected to the dimple tops of a second neighboring heat exchanger plate, wherein at least part of the dimples are connected to at least one adjacent dimple by a wall section, wherein at least some of the wall sections have the same height as the dimples forming closed dimple pairs and the at least some of the wall sections of the at least one heat exchanger plate are in contact with corresponding wall sections of the first and second neighboring heat exchanger plates to completely block a fluid path where the closed dimple pairs meet, wherein the connection between the dimple tops of the at least one heat exchanger plate and the dimple bottoms of the first neighboring heat exchanger plate keeps the at least one heat exchanger plate and the first neighboring heat exchanger plate spaced apart to form a first flow path therebetween, wherein the connection between the dimple bottoms of the at least one heat exchanger plate and the dimple tops of the second neighboring heat exchanger plate keeps the at least one heat exchanger plate and the second neighboring heat exchanger plate spaced apart to form a second flow path therebetween, and wherein the wall sections together with the adjacent dimples connected by the wall sections form a pattern of closed barriers within the first and second flow paths directing fluid flow across a plane of the at least one heat exchanger plate, wherein at least some of the wall sections protrude in a direction perpendicular to the plane of the heat exchanger plate to a lower height than the dimples.

2. The heat exchanger according to claim 1, wherein at least some of the dimples or wall sections comprise concave surface sections or convex surface sections.

3. The heat exchanger according to claim 1, wherein at least some of the wall sections connect three or more dimples.

4. The heat exchanger according to claim 1, wherein the dimples or the wall sections are elastically deformable.

5. The heat exchanger according to claim 1, wherein at least some of the wall sections have a minimum width that is smaller than a maximum width of the dimples.

6. The heat exchanger according to claim 1, wherein at least part of the dimples comprising tops are arranged in first rows and at least part of the dimples comprising bottoms are arranged in second rows.

7. The heat exchanger according to claim 6, wherein all dimples in each first row as well as all dimples in each second row are connected by wall sections.

8. The heat exchanger according to claim 6, wherein in each first row and in each second row wall sections with the same height as the dimples are arranged alternately with wall sections with a lower height than the dimples.

9. The heat exchanger according to claim 6, wherein at least part of the first and second rows are arranged parallel to an edge of the heat exchanger plate.

10. The heat exchanger according to claim 6, wherein at least part of the first and second rows are arranged at an angle to an edge of the heat exchanger plate.

11. The heat exchanger according to claim 6, wherein at least part of the first and second rows change direction within the plane of the heat exchanger plate.

12. The heat exchanger according to claim 1, wherein at least part of the dimples comprising tops are arranged alternately with dimples comprising bottoms along a direction parallel to an edge of the heat exchanger plate.

13. The heat exchanger according to claim 1, wherein at least part of the dimples comprising tops are arranged alternately with dimples comprising bottoms along a direction inclined to an edge of the heat exchanger plate.

14. The heat exchanger according to claim 1, wherein the tops and bottoms are essentially flat such that a flat plane of a top meets a flat plane of a bottom when heat exchanger plates are connected.

15. The heat exchanger according to claim 14, wherein the dimples are of similar shapes.

16. A heat exchanger comprising:

a plurality of heat exchanger plates, each heat exchanger plate of the plurality of heat exchanger plates comprising:

a plurality of each dimple of the plurality of dimples comprising:

a top or bottom surface;

a plurality of wall sections, each wall section connecting at least one dimple to at least one adjacent dimple, the connected dimples both having either top surfaces or bottom surfaces;

wherein the wall sections have the same height as the dimples forming closed dimple pairs;

wherein the top surfaces of closed dimple pairs having top surfaces of at least one heat exchanger plate of the plurality of heat exchanger plates are aligned with and connected to the bottom surfaces of dosed dimple pairs having bottom surfaces of a first neighboring heat exchanger plate to keep the at least one heat exchanger plate and the first neighboring heat exchanger plate spaced apart to form a first fluid path therebetween;

wherein the bottom surfaces of dosed dimple pairs having bottom surfaces of the at least one the heat exchanger plate are aligned with and connected to the top surfaces of dosed dimple pairs having top surfaces of a second neighboring heat exchanger plate to keep the at least one heat exchanger plate and the second neighboring heat exchanger plate spaced apart to form a second fluid path therebetween;

wherein the wall sections of the connected dosed dimple pairs of the first and second neighboring heat exchanger plates are in contact with the wall sections of the connected dosed dimple pairs of the at least one heat exchanger plate to completely block the fluid path where the dosed dimple pairs meet; and wherein the wall sections and dimples of the connected dosed dimple pairs form a pattern of dosed barriers within the first and second fluid paths directing fluid flow across a plane of the at least one heat exchanger plate, wherein at least some of the wall sections protrude in a direction perpendicular to the plane of the heat exchanger plate to a lower height than the dimples.

* * * * *